US007156192B2

(12) United States Patent
Guerrero et al.

(10) Patent No.: US 7,156,192 B2
(45) Date of Patent: Jan. 2, 2007

(54) OPEN HOLE TRACTOR WITH TRACKS

(75) Inventors: Julio C. Guerrero, Cambridge, MA (US); Falk W. Doering, Houston, TX (US); Carl J. Roy, Richmond, TX (US); Paul J. Beguin, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 277 days.

(21) Appl. No.: 10/891,782

(22) Filed: Jul. 15, 2004

(65) Prior Publication Data

US 2005/0034874 A1 Feb. 17, 2005

Related U.S. Application Data

(60) Provisional application No. 60/487,699, filed on Jul. 16, 2003.

(51) Int. Cl.
*E21B 7/04* (2006.01)

(52) U.S. Cl. ..... 175/51; 175/90; 175/106

(58) Field of Classification Search ..... 175/90, 175/106, 51; 166/382, 206, 216
See application file for complete search history.

(56) References Cited

U.S. PATENT DOCUMENTS

| | | | | |
|---|---|---|---|---|
| 5,184,676 | A | 2/1993 | Graham | 166/66.4 |
| 5,794,703 | A | 8/1998 | Newman | 166/381 |
| 5,954,131 | A | 9/1999 | Sallwasser | 166/254.2 |
| 6,082,461 | A | 7/2000 | Newman | 166/381 |
| 6,089,323 | A | 7/2000 | Newman | 166/381 |
| 6,179,055 | B1 | 1/2001 | Sallwasser | 166/254.2 |
| 6,273,189 | B1 | 8/2001 | Gissler | 166/241.1 |
| 6,629,568 | B1 | 10/2003 | Post | 166/382 |
| 6,920,936 | B1 * | 7/2005 | Sheiretov et al. | 166/382 |
| 2002/0102136 | A1 | 8/2002 | Holland | 405/184.1 |
| 2005/0145415 | A1 * | 7/2005 | Doering et al. | 175/24 |
| 2005/0263325 | A1 * | 12/2005 | Doering et al. | 175/106 |

FOREIGN PATENT DOCUMENTS

WO WO 2005/068773 * 7/2005

* cited by examiner

*Primary Examiner*—William P. Neuder
(74) *Attorney, Agent, or Firm*—Rodney Warfford; Tim Curington; Bill Batzer

(57) ABSTRACT

A downhole tractor is provided that may be used in open or cased wells, and is also designed for use in open holes having a variety of soil/formation consistencies (e.g., soft, firm, rigid, etc.), varying diameters and non-uniform and irregular bore profiles. The tractor may include a track assembly including a plurality of idler wheels and a continuous track rotatably disposed around the idler wheels. A motor may be adapted to rotate the track around the idler wheels. Upper and lower arms may be pivotally connected to opposite ends of the track assembly and pivotally connected to a tractor housing. An actuator arm or link assembly may be provided to impart an outward force to the track assembly to move the track assembly outwardly into an open position and a retracting force to retract the track assembly into a closed position. A rotatable screw may be connected to a second motor, or a rod may be connected to a hydraulic system, to actuate the actuator arm or link assembly.

45 Claims, 13 Drawing Sheets

OPEN HOLE TRACTOR WITH TRACKS

CROSS-REFERENCE TO RELATED APPLICATIONS

This application claims priority from U.S. Provisional Application No. 60/487,699, filed Jul. 16, 2003, which is incorporated herein by reference.

BACKGROUND OF THE INVENTION

1. Field of the Invention

The present invention generally pertains to apparatus, systems and methods for conveying equipment in a well, and more particularly to a downhole tractor that may be used in both open and cased wells and that is adaptable when used in open holes to all types of soil conditions and formation consistencies, whether they be soft, firm, or otherwise.

2. Description of the Related Art

It is known within the oil and gas industry to use a downhole tractor to convey equipment, such as logging equipment, within a well, and that the use of a downhole tractor is often especially useful when it is desired to convey equipment in highly-deviated and horizontal well bores. Examples of downhole tractors can be found in U.S. Pat. Nos. 4,670,862 issued on Jun. 2, 1987 to Staron et al. and U.S. Pat. No. 6,089,323 issued on Jul. 18, 2000 to Newman et al. The prior downhole tractors are deficient in a variety of respects, including in the areas of operating in open holes wherein the tractor may be required to traverse a variety of soil/formation consistencies (e.g., soft, firm, rigid, etc.), and in bore holes having varying diameters and non-uniform and irregular bore profiles. Also, the prior tractors are deficient in their ability to develop the forces required to convey the tools used in open holes for formation evaluation, which are usually much heavier than the tools used in cased holes for production logging. Another area in which prior tractors are deficient is in their ability to operate while submerged in drilling fluids at high temperatures well above 150 degrees C.; this is due in part to the poor efficiency of such prior tractors in dissipating heat. As will become apparent from the following description and discussion, however, the present invention overcomes the deficiencies of the previous devices and constitutes an improved and more efficient downhole tractor.

SUMMARY OF THE INVENTION

In a broad aspect, the present invention may be a downhole tractor comprising: a track assembly including a rotatable track; a motor adapted to rotate the track; a lower arm having a first end supported by a tractor housing, and a second end connected to the track assembly; an upper arm having a first end supported by the tractor housing, and a second end connected to the track assembly; and an actuator arm mounted to move the track assembly between open and closed positions. Another feature of this aspect of the invention may be that the track is rotatably disposed about a plurality of wheels mounted to the track assembly. Another feature of this aspect of the invention may be that the track includes a plurality of wheels. Another feature of this aspect of the invention may be that the tractor may further include one of a rotatable screw and a rod, and wherein the actuator arm includes a first end pivotally connected to one of the screw and the rod and a second end pivotally connected to the track assembly. Another feature of this aspect of the invention may be that the track rotates along a path defined by the general shape of one of an oval, parallelogram, trapezoid and triangle. Another feature of this aspect of the invention may be that the device may further include a transmission connected between the motor and a driven wheel adapted to rotate the track. Another feature of this aspect of the invention may be that the device may further include a rotatable screw connected, directly or indirectly, to the actuator arm, whereby the screw causes the actuator arm to move the track assembly towards its open position when the screw is rotated in a first direction and to move the track assembly towards its closed position when the screw is rotated in second direction. Another feature of this aspect of the invention may be that the device may further include a rod connected to the actuator arm, whereby the rod causes the actuator arm to move the track assembly towards its open position when the rod is moved in a first direction and to move the track assembly towards its closed position when the rod is moved in second direction. Another feature of this aspect of the invention may be that the first end of the lower arm is disposed for movement within a slot in the tractor housing. Another feature of this aspect of the invention may be that the device may further include a slider assembly connected to the track assembly and the lower arm, and adapted to permit relative movement between the track assembly and the lower arm. Another feature of this aspect of the invention may be that the device may further include a slider assembly having an inner member disposed for movement within a bore of an outer member, one of the inner member and outer member being connected to the upper arm and the other of the inner member and the outer member being connected to the track assembly. Another feature of this aspect of the invention may be that the actuator arm includes a wheel engaged with a ramp mounted to the tractor housing. Another feature of this aspect of the invention may be that the track assembly further includes a driven wheel coupled directly or indirectly to the motor. Another feature of this aspect of the invention may be that the motor is coupled directly or indirectly to a rotatable screw that is engaged with the track, whereby rotation of the screw causes rotation of the track.

In another aspect, the invention may be a downhole tractor comprising: a track assembly including a plurality of idler wheels and a continuous track rotatably disposed around the idler wheels; a motor adapted to rotate the track around the idler wheels; a lower arm having a first end pivotally connected to a tractor housing, and a second end pivotally connected to the track assembly; an upper arm having a first end pivotally connected to the tractor housing, and a second end pivotally connected to the track assembly; one of a rotatable screw and a rod; and a link assembly including a first link having a first end pivotally connected to one of the screw and the rod and a second end pivotally connected to the track assembly, and a second link having a first end pivotally connected to the track assembly and a second end pivotally mounted to the tractor housing. Another feature of this aspect of the invention may be that the second end of the first link and the first end of the second link are pivotally mounted to the track assembly at a pivot point on the track assembly. Another feature of this aspect of the invention may be that the first end of the lower arm is disposed for movement within a slot in the tractor housing. Another feature of this aspect of the invention may be that the track rotates along a path defined by the general shape of one of an oval, parallelogram, trapezoid and triangle. Another feature of this aspect of the invention may be that the device may further include a transmission connected between the motor and a driven wheel. Another feature of this aspect of the invention may be that the device further includes a hydraulic system adapted to move the rod between a first position in which the track assembly is in a closed position and a second position in which the track assembly is in an open position. Another feature of this aspect of the invention may be that the device further includes a second motor adapted to rotate the screw in a first direction to cause the track assembly to move towards an open position and a second direction to cause the track assembly to move towards a closed position. Another feature of this aspect of the invention may be that one of the screw and rod is adapted to move the first end of the first link in a direction generally parallel to a central axis of the tractor housing. Another feature of this aspect of the invention may be that the device further includes a slider assembly connected to the track assembly and the lower arm, and adapted to permit relative movement between the track assembly and the lower arm. Another feature of this aspect of the invention may be that the track assembly further includes a driven wheel coupled directly or indirectly to the motor. Another feature of this aspect of the invention may be that the motor is coupled directly or indirectly to a second rotatable screw that is engaged with the track, whereby rotation of the second rotatable screw causes rotation of the track.

In another aspect, the invention may be a downhole tractor comprising: a track assembly including a plurality of idler wheels and a continuous track rotatably disposed around the idler wheels; a motor adapted to rotate the track around the idler wheels; a lower arm having a first end pivotally connected to a tractor housing, and a second end pivotally connected to the track assembly; an upper arm having a first end pivotally connected to the tractor housing, and a second end pivotally connected to the track assembly; one of a rotatable screw and a rod; and an actuator arm having a first end pivotally connected to one of the screw and the rod, a second end pivotally connected to the track assembly, and a wheel engaged with a ramp connected to the tractor housing. Another feature of this aspect of the invention may be that the first end of the lower arm is disposed for movement within a slot in the tractor housing. Another feature of this aspect of the invention may be that the device further includes a transmission connected between the motor and a driven wheel. Another feature of this aspect of the invention may be that the device further includes a hydraulic system adapted to move the rod between a first position in which the track assembly is in a closed position and a second position in which the track assembly is in an open position. Another feature of this aspect of the invention may be that the device further includes a second motor adapted to rotate the screw in a first direction to cause the track assembly to move towards an open position and a second direction to cause the track assembly to move towards a closed position. Another feature of this aspect of the invention may be that one of the screw and rod is adapted to move the first end of the first link in a direction generally parallel to a central axis of the tractor housing. Another feature of this aspect of the invention may be that the device further includes a slider assembly connected to the track assembly and the lower arm, and adapted to permit relative movement between the track assembly and the lower arm. Another feature of this aspect of the invention may be that the track assembly further includes a driven wheel coupled directly or indirectly to the motor. Another feature of this aspect of the invention may be that the motor is coupled directly or indirectly to a second rotatable screw that is engaged with the track, whereby rotation of the second rotatable screw causes rotation of the track. Another feature of this aspect of the invention may be that the device further includes a second downhole tractor spaced from the downhole tractor by a distance greater than a length of a washed out section of a well bore.

In another aspect, the invention may be a method of conveying an item in a well bore, comprising: providing a downhole tractor including a track assembly including a rotatable track, a motor adapted to rotate the track, a lower arm having a first end pivotally connected to a tractor housing and a second end pivotally connected to the track assembly, an upper arm having a first end pivotally connected to the tractor housing and a second end pivotally connected to the track assembly, and an actuator arm mounted to move the track assembly between open and closed positions; connecting the item to the tractor, engaging the track with an inner surface of the well bore, activating the motor, and moving the tractor along the surface. Another feature of this aspect of the invention may be that the method may further include providing a second downhole tractor spaced from the downhole tractor by a distance greater than a length of a washed out section of a well bore.

Other features, aspects and advantages of the present invention will become apparent from the following discussion

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
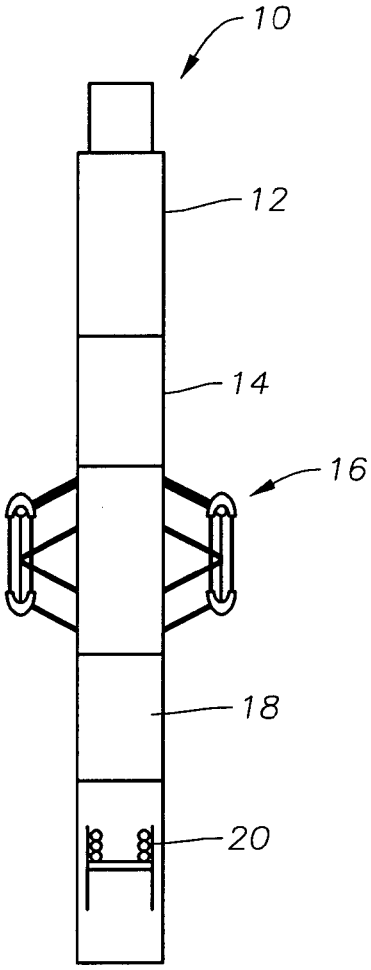
FIG. 1 is a side view of a specific embodiment of an open hole tractor constructed in accordance with the present invention
Figure 2:
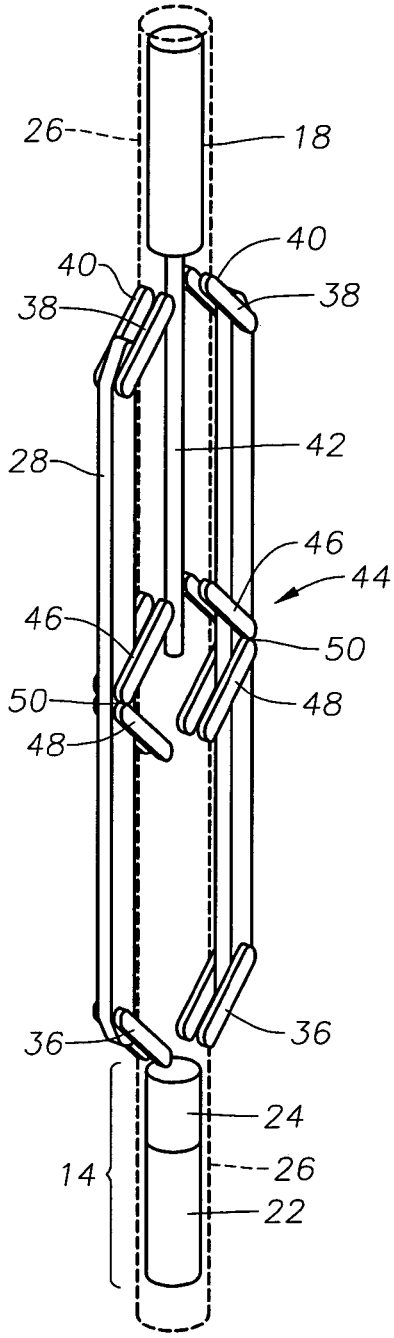
FIG. 2 is a more detailed side view of an open hole tractor constructed in accordance with the present invention.

Referring to the drawings in detail, wherein like numerals denote identical elements throughout the several views, there is shown in FIG. 1 a specific embodiment of an open hole tractor 10 constructed in accordance with the present invention that may include five main sections: (1) an electronics section 12; (2) a drive section 14; (3) a track section 16; (4) an open/close system 18 for opening and closing the track section; and (5) a compensation system 20 for providing the internal pressure required to compensate the system against downhole pressure. A more detailed illustration of a specific embodiment of the present invention is shown in FIG. 2, wherein the drive section 14 may include a motor 22 and a gear box 24 connected in series and enclosed within a tractor housing 26. The motor 22 and gear box 24 are preferably submerged in oil which is maintained at a proper pressure by the compensation system 20. The output of the gear box 24 is used to drive one or more track assemblies 28.

Figure 3:
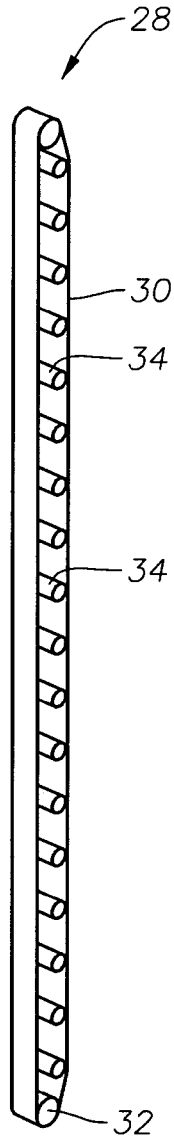
FIG. 3 is a side view showing the details of a track assembly that may be included in the tractor shown in FIG. 2.

As shown in FIG. 3, in a specific embodiment, each track assembly 28 may include a continuous track 30 (e.g., a belt, chain or other flexible device) disposed about a driven wheel 32 and a plurality of idler wheels 34. Other means, besides idler wheels, of applying the pressure of the tracks on the bore hole may be used, as long as they spread the application force over the whole track area. In a specific embodiment, each driven wheel 32 may include a localized suspension system to facilitate the engagement of the track 32 with the well bore. The length of the track 30 is the predominant factor affecting its tractive effort. Other parameters that influence the track performance include the wheel diameters, the wheel spacing, the number of wheels, and the relative distance between the wheels. All of these factors are preferably taken into account when dimensioning tractor 10.

Figure 5:
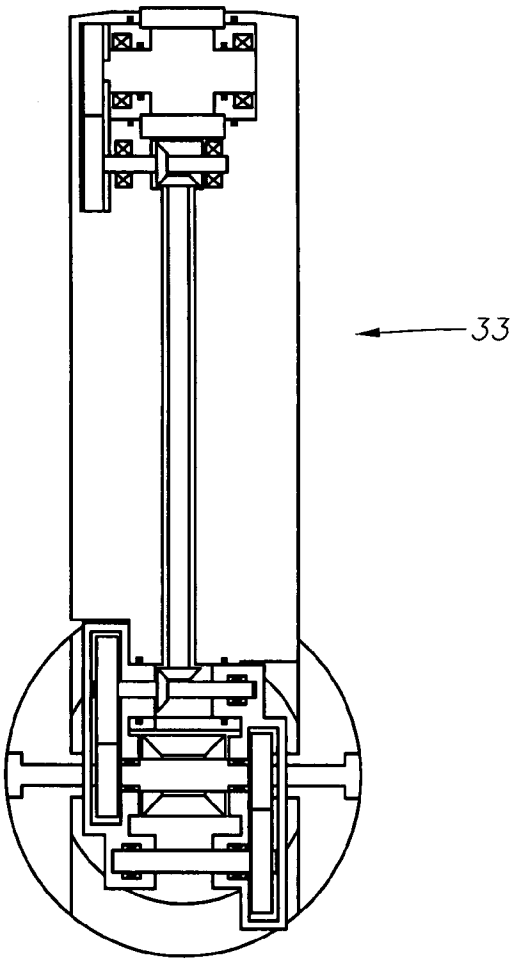
FIG. 5 shows one embodiment of a change-in-direction gear.
Figure 4:
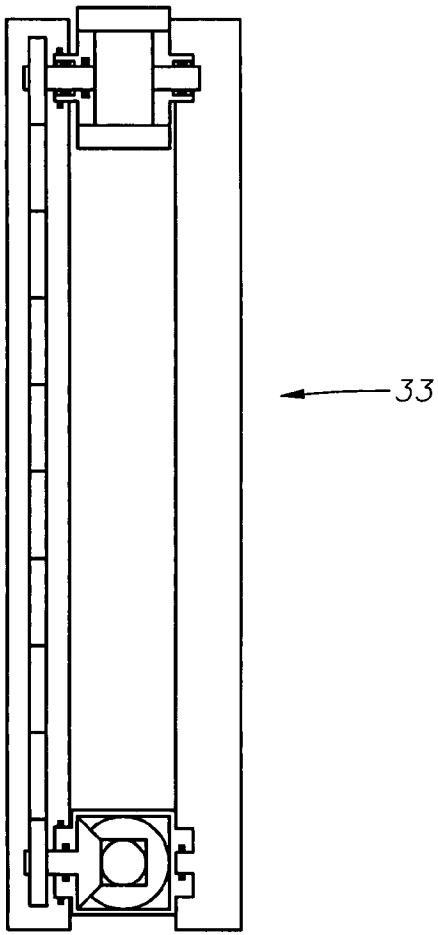
FIG. 4 shows one embodiment of a change-in-direction gear.
Figure 6:
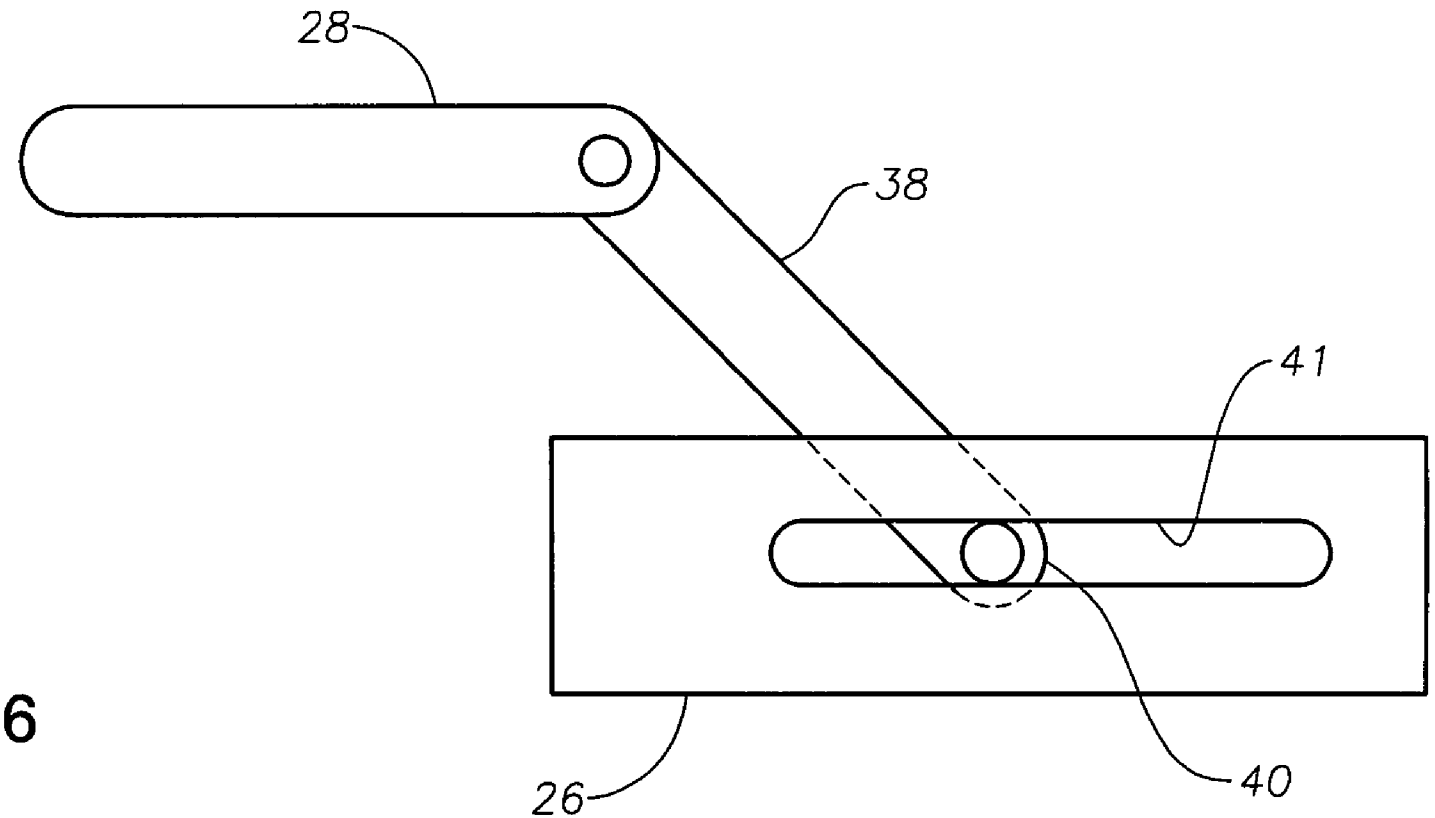
FIG. 6 is a side view showing the manner in which a track assembly may be connected through an arm that is pivotally disposed in a slot to move generally along a central axis of the tractor.

Referring back to FIG. 2, the tractor 10 may further include upper arms 36 to pivotally connect the upper ends of the track assemblies 28 to the tractor housing 26. In a specific embodiment, the upper arms 36 may each include a power transmission system of any known type for transmitting the rotary power from the gear box 24 to the driven wheels 32, including, for example, through a change-of-direction gear 33 such as shown in FIGS. 4 and 5. The tractor 10 may further include lower arms 38 to pivotally connect the lower ends of the track assemblies 28 to the tractor housing 26. In another specific embodiment, as will be more fully discussed below in relation to FIG. 15, a motor 22 and gear box 24 may be mounted on or within one or more of the lower and upper arms 36 and 38. In a specific embodiment, as shown in FIG. 6, the lower ends 40 of the lower arms 38 that are connected to the housing 26 may be pivotally disposed in a slot 41 to move generally along a central axis of the tractor 10 to allow for the engagement and retraction of the track assemblies 28. In another specific embodiment, as more fully explained below, the lower ends 40 may be pivotally fixed to the tractor housing 26 and the tractor may further include a slider assembly to allow for deployment and retraction of the track assemblies 28.

The manner in which the track assemblies 28 may be deployed and retracted will now be explained. Still referring to FIG. 2, the open/close system 18 may comprise a motor adapted to rotate a power screw 42 that is coupled to a link assembly 44. The link assembly 44 is connected to the track assembly 28. In a specific embodiment, each link assembly 44 may include a lower link (or actuator arm) 46 and an upper link 48. A lower end of each lower link 46 is connected to the power screw 42, in any known manner, such as through a nut adapted for threadable movement along the power screw 42. An upper end of each lower link 46 and a lower end of each upper link 48 are, in a specific embodiment, pivotally attached to each track assembly 28, such as at a pivot point 50. An upper end of each upper link 48 is pivotally affixed to the tractor housing 26. In this manner, when the power screw 42 is rotated in a first direction to cause upward movement of the lower ends of the lower links 46, the link assembly 44 will impart an outward force to the track assemblies 28 and move them into a deployed position and into contact with a bore hole (not shown) in which the tractor 10 may be disposed. Similarly, when the power screw 42 is rotated in a second direction, the lower ends of the lower links 46 are moved downwardly so as to cause the link assembly 44 to retract the track assemblies 28 into their closed positions (not shown). In a specific embodiment, the power screw 42 may include a suspension system to compensate for the overall roughness of the formation.

Figure 7:
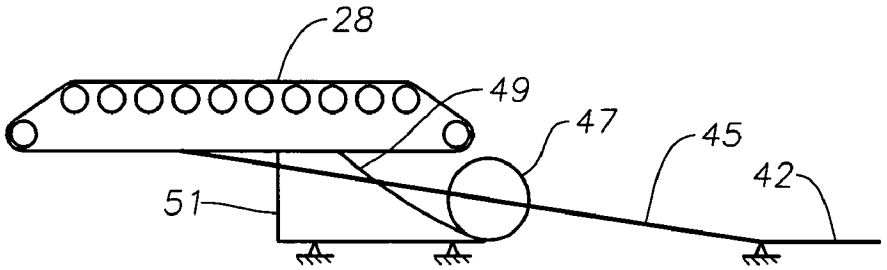
FIG. 7 is a side view showing an actuator arm attached to a track assembly (shown in a closed position) for use in moving the track assembly between open and closed positions and to apply a substantially constant outward force to the track assembly.
Figure 8:
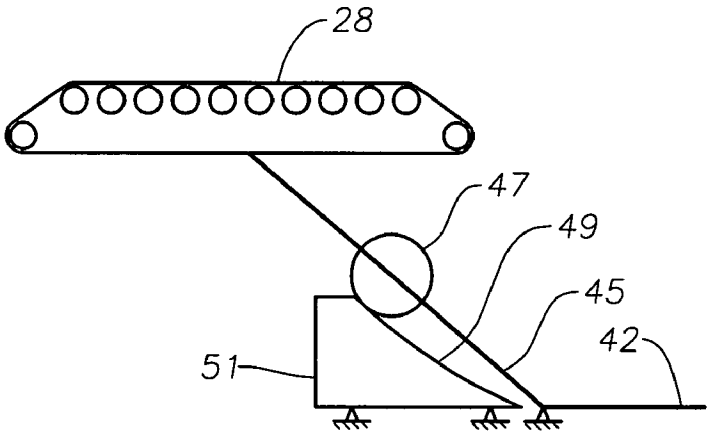
FIG. 8 is a view similar to FIG. 7, but shows the track in an open or engaged position.
Figure 9:
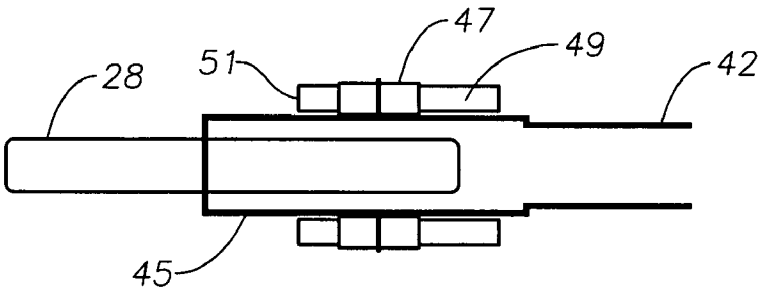
FIG. 9 is a top view showing showing the actuator arm and other components illustrated in FIGS. 7 and 8.

The present invention is not intended to be limited to any particular mechanical assembly for opening and closing the track assemblies 28, and for preferably imparting a substantially constant outward force to the track assemblies 28 when in their open and engaged position. Other examples are also within the scope of the present invention. For example, in another specific embodiment, the power screw 42 may be a ball screw. In another specific embodiment, the system 18 may comprise a hydraulic system adapted to extend and retract a rod 42 that may be pivotally connected to the lower ends of the lower links 46 to open and close the track assemblies 28 in the same way as explained above. In still another specific embodiment, the tractor 10 may include a constant force actuator of the type disclosed in pending U.S. patent application Ser. No. 10/321,858, filed on Dec. 17, 2002, and entitled "Constant Force Actuator" and published as U.S. Pat. No. 2003/0173076 ("the '858 application"), which is commonly assigned to the assignee of the present application, and fully incorporated herein by reference. For example, as shown in FIGS. 7–9, instead of providing the link assembly 44 with two links (i.e., lower and upper links 46 and 48), it may be provided with only a lower link 46, which is designated here as an actuator arm 45. In this embodiment, the actuator arm 45 may include a wheel 47 rotatably mounted thereto for rolling engagement with a ramp surface 49 on a wedge member 51 that is mounted to the tractor housing 26. At one end, the actuator arm 45 may be pivotally connected to the screw or rod 42 and at the opposite end to the track assembly 28. FIG. 7 shows the wheel 47 at a lower end of the ramp surface 49 with the track assembly 28 in a closed or retracted position. FIG. 8 shows the wheel 47 at an upper end of the ramp surface 49 with the track assembly 28 being positioned in an engaged or deployed position. FIG. 9 is a top view, and illustrates that this aspect of the invention may be provided with an actuator arm 45, wedge member 51, and wheel 47 in both sides of the track assembly 28.

In a specific embodiment, the tractor 10 may employ the methods disclosed in pending U.S. patent application Ser. No. 10/751,599, filed on Jan. 5, 2004, and entitled "Improved Traction Control For Downhole Tractor" ("the '599 application") which is commonly assigned to the assignee of the present application, and fully incorporated herein by reference. The methods of the '599 application can be used in the present invention to control the outward normal force applied through the link assembly 44 to the track assemblies 28.

Figure 10:
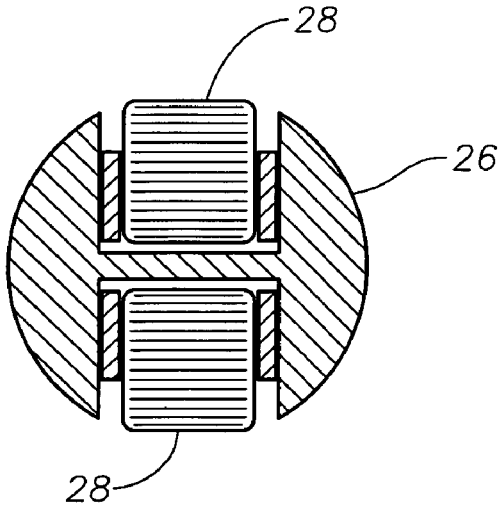
FIG. 10 is a cross-sectional view showing a specific embodiment of the present invention in which the tractor may include two track assemblies.
Figure 11:
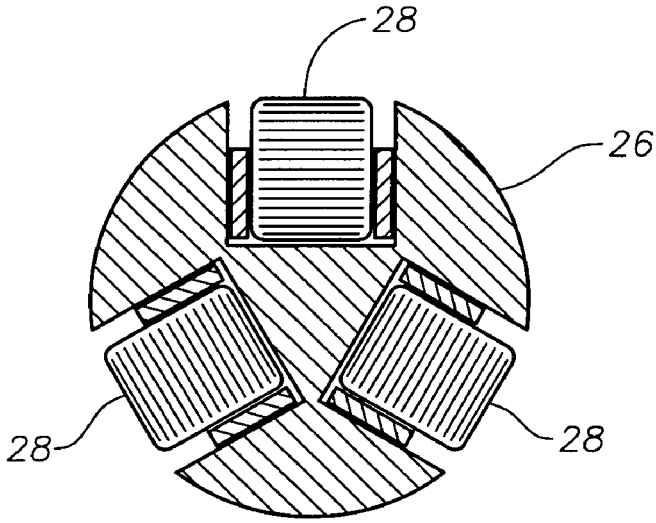
FIG. 11 is another cross-sectional view showing another specific embodiment of the present invention in which the tractor may include three track assemblies.
Figure 12:
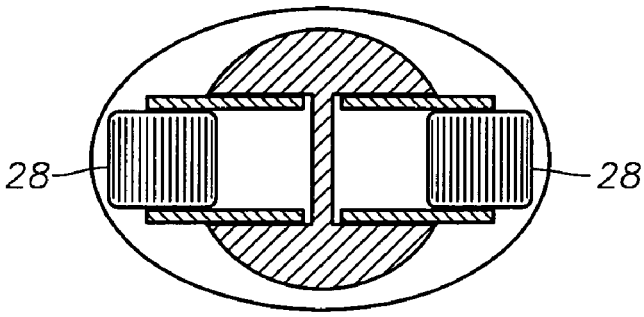
FIG. 12 is another cross-sectional view showing the embodiment of FIG. 10 in which the tractor may be constructed for use in an elliptical well bore.

The specific embodiment of the present invention as shown in FIG. 2 includes two track assemblies 28. This is further illustrated in FIG. 10, which is a cross-sectional view showing the track assemblies 28 in closed positions. But the present invention is not limited to any specific number of track assemblies 28. For example, as shown in FIG. 11, the tractor 10 may include three track assemblies 28 positioned at 120 degree angles to each other. In a specific embodiment, the three-track configuration may be used when only one track assembly 28 includes a driven wheel 32 and the other two track assemblies 28 are passive and serve only to centralize the tractor 10 with the bore and minimize friction by rolling instead of sliding. In another specific embodiment, the three-track configuration may be used when all three track assemblies 28 include a driven wheel 32. The number of track assemblies 28 may be determined at least in part based upon the outer diameter of the tractor 10 and the width of the tracks 30. As shown in FIG. 12, the present invention may also be constructed for use in bore holes that are not generally circular, such as, for example, elliptical bore holes.

Figure 13:
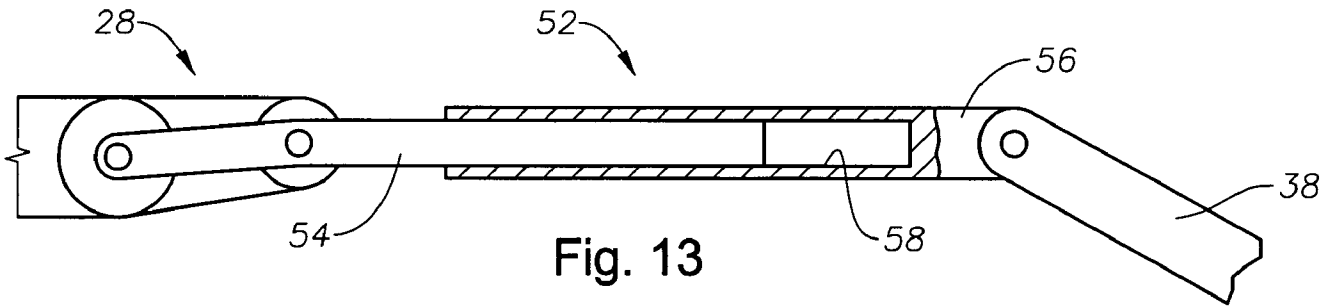
FIG. 13 is a side view illustrating a portion of a specific embodiment of the tractor of the present invention in which a slider assembly is illustrated.
Figure 22:
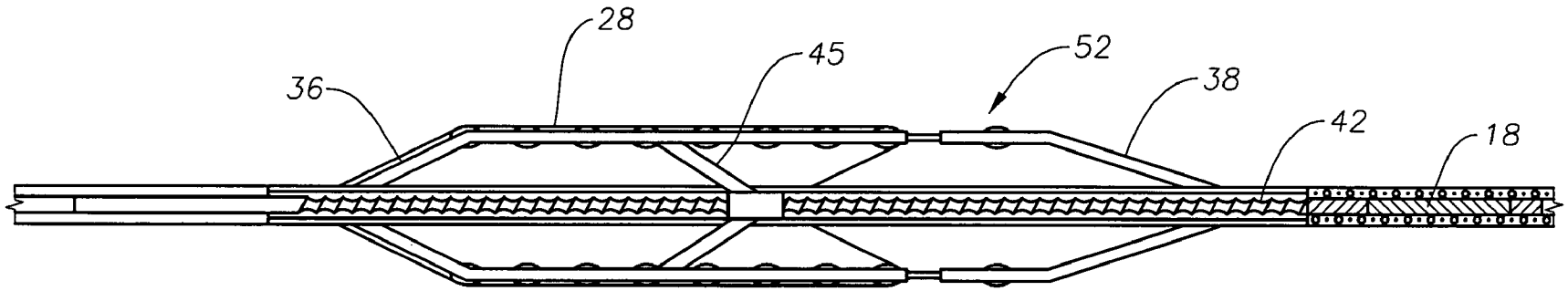
FIG. 22 is a side view of another specific embodiment of the present invention which is similar to FIG. 19.
Figure 25:
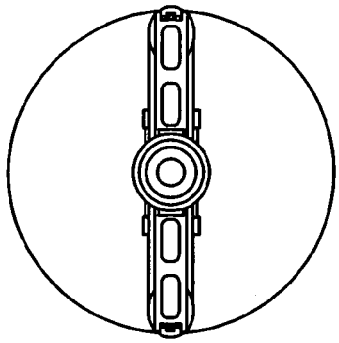
FIG. 25 is an end view showing the embodiment of FIGS. 23 and 24 deployed within and engaged with a well bore.
Figure 23:
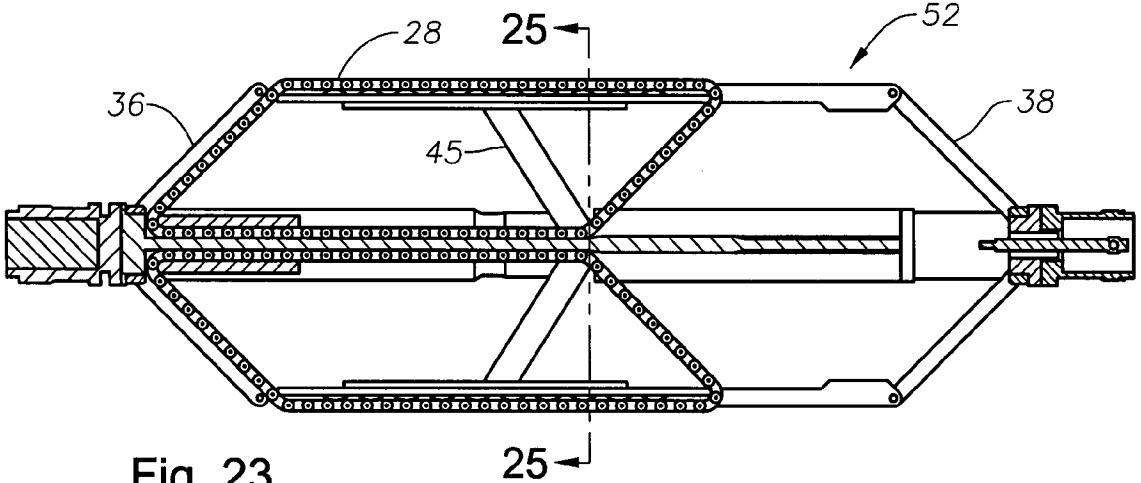
FIG. 23 is a side view of another specific embodiment of the present invention which is similar to FIG. 22, and which is shown in an open or deployed position.
Figure 24:
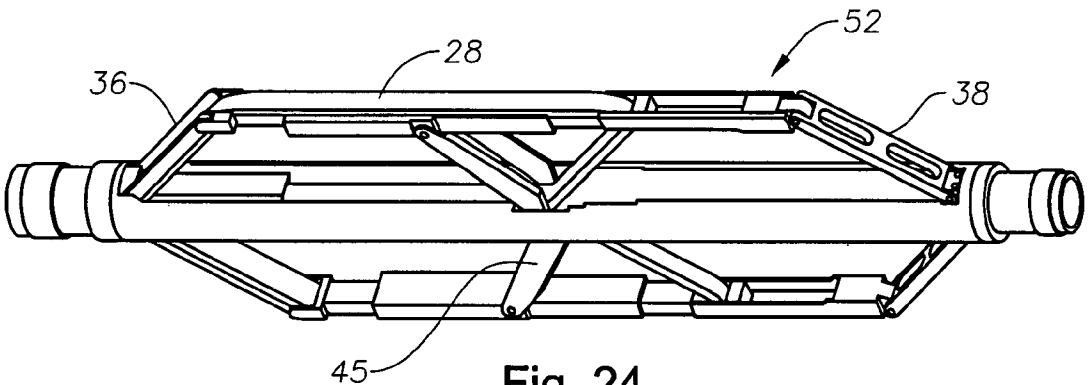
FIG. 24 is a perspective view of the embodiment shown in FIG. 23.
Figure 26:
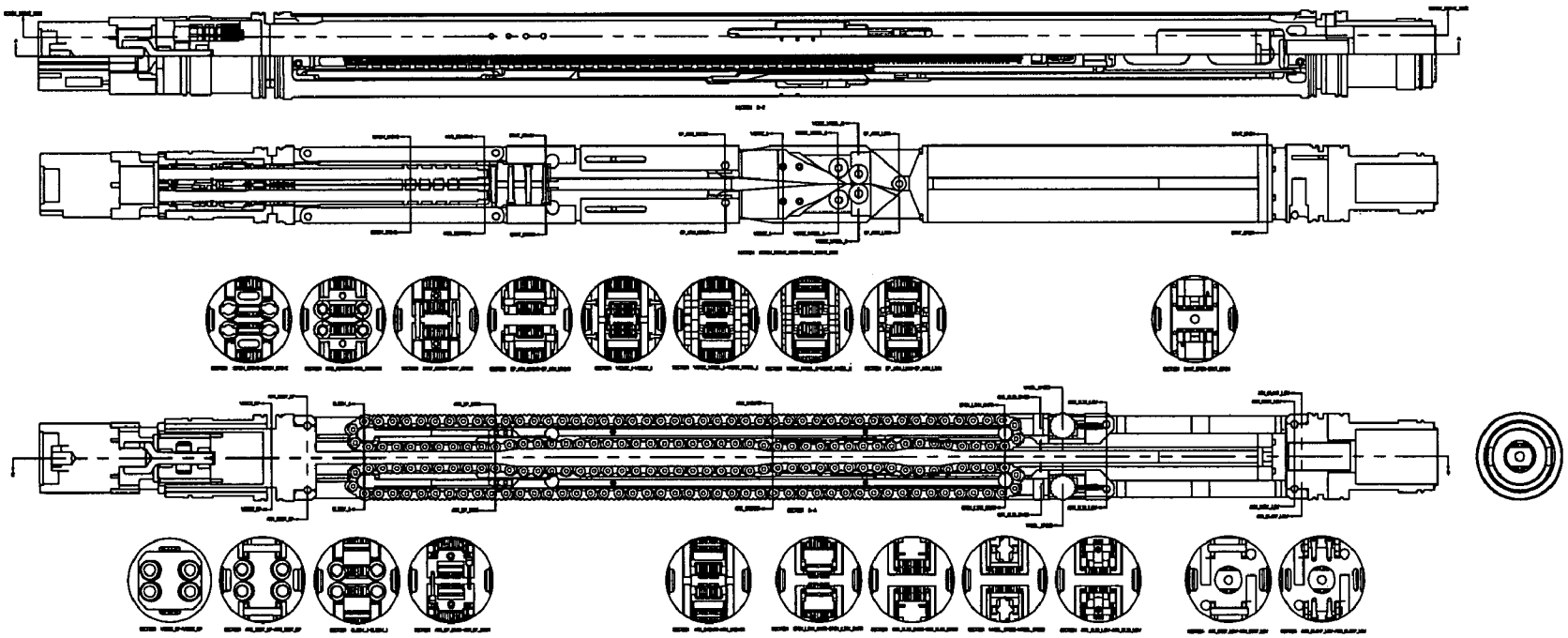
FIG. 26 is a collection of side and cross-sectional views showing the embodiment of FIGS. 23–25 in a closed position.
Figure 29:
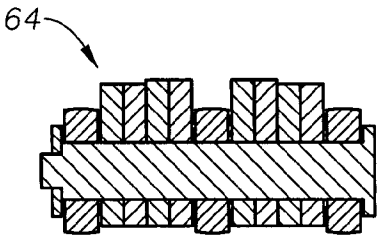
FIG. 29 is a cross-sectional view taken along line 29—29 of FIG. 28.
Figure 30:
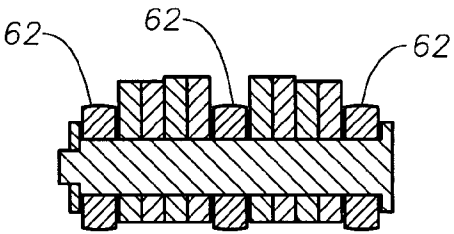
FIG. 30 is a cross-sectional view taken along line 30—30 of FIG. 28.
Figure 27:
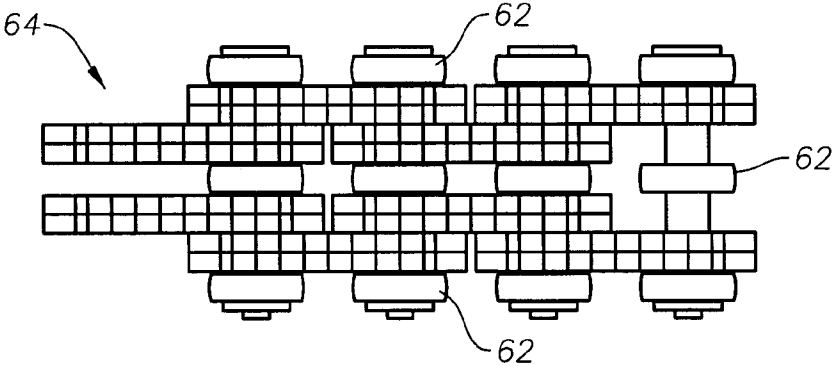
FIG. 27 is a top view of a chain-link track with rollers that may be used with the embodiments shown in FIGS. 23–26.
Figure 28:
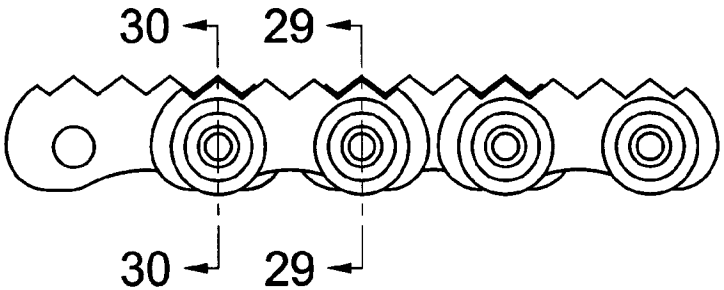
FIG. 28 is a side view of the track shown in FIG. 27.
Figure 31:
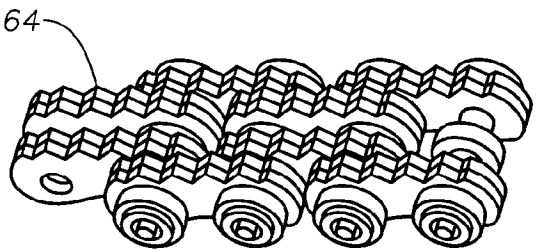
FIG. 31 is a perspective view of the track shown in FIGS. 27–30.

In another specific embodiment, as briefly mentioned above, the upper and lower arms 36 and 38 that are connected at each end of the track assemblies 28 may be pivotally fixed to the tractor housing 26. In this case, some mechanism is required to allow the upper and lower arms 36 and 38 to rotate inwardly towards the central axis of the tractor 10 and toward each other. In accordance with this aspect of the present invention, in a specific embodiment, as shown in FIG. 13, a slider assembly 52 may be connected between a lower end of each track assembly 28 and the upper end of each lower arm 38. In a specific embodiment, the slider assembly 52 may include an inner member 54, and an outer member 56 having a bore 58. The inner member 54 may be connected to the track assembly 28 and disposed for movement within the bore 58 of the outer member 56. The outer member 56 may be pivotally connected to the upper arm 38. Another specific embodiment of a slider assembly 52 is shown in FIG. 22, discussed below. One benefit of a slider mechanism is that it allows the upper and lower arms 36 and 38 to be pivotally connected to the tractor housing 26. This greatly simplifies the coupling of the motor 22 to the tracks since they are fixed with respect to each other, whereas in typical linkages found in downhole tools, both upper and lower arms are slidable to allow for a smooth entry into restrictions.

In another specific embodiment, instead of transmitting rotary motion from the gear box 24 to the driven wheels 32 of the track assemblies 28, the driven wheels 32 may be replaced with idler wheels and the rotary motion may be transferred to the track 30 through a screw of the type disclosed in pending U.S. patent application Ser. No.10/857,395, filed on May 28, 2004, and entitled "Chain Drive System", which is commonly assigned to the assignee of the present application, and fully incorporated herein by reference.

Irrespective of the method of imparting movement to the track 30, as the track 30 rotates, a considerable portion of its surface engages the bore hole (not shown) in which the tractor 10 is disposed. The interaction of the track 30 with the bore hole produces the tractoring forces that propel the tractor 10 inside the bore. These tractoring forces are generally determined by two parameters: (1) the amount of power that is applied by the drive section 14 to the track 30; and (2) the amount of outward/normal force applied to track assemblies 28. These two parameters are preferably controlled to optimize operation and movement of the tractor 10 depending upon the nature of the formation in which the bore being traversed is located. The formulation that produces the desired result varies for soft versus rigid formations. For example, when the formation in which the bore is disposed is soft, the tractor 10 produces the tractoring force by shearing the formation. The discussion below for Equations 1, 2 and 3 apply to tractoring on soil when using off-road vehicles which is conceptually similar to tractoring in soft formations. The discussion for Equations 4 and 5 apply to tractoring in rigid formations and also apply to cased holes. The present invention may also tractor in pipe, in which case the equations for rigid formations apply.

Equation 1 shows the relationship between the tractoring force, the contact area, the soil properties, the normal load exerted on the terrain (e.g. formation, soil), the track length and the slippage when a tractor is in a soft soil, which is conceptually similar to some soft formations. The variables of the Equation 1 are described in the Table 1.

Total tractive effort of a track — Equation 1

$$TF = (A*C + NF*\mathrm{Tan}(\phi))*\left[1 - \frac{K}{i*l}*\left(1 - e^{\left(\frac{-i*l}{k}\right)}\right)\right]$$

Equation 1 is applicable for predicting the tractive effort of a track with uniform normal distribution for a given type of soil.

TABLE 1

Variables for total tractive effort of a track

| Variable name | Symbol | Units |
|---|---|---|
| Tractoring force | TF | Newtons |
| Track contact area | A | $m^2$ |
| Apparent cohesion coefficient | C | Newtons/$m^2$ |
| Angle of internal shearing of the terrain | ϕ | Radians |
| Shear deformation modulus | K | M |
| Total track length | 1 | M |
| Slippage coefficient | I | # |
| Normal force acting on the formation | NF | Newtons |

A vehicle encounters a resistance to movement given by the terrain. This resistance is a function of the terrain characteristics, the track dimensions, and the normal force the vehicle exerts on the terrain. Equation 2 shows this relation and Table 2 explains the parameters of Equation 2. The total traction (net tractoring force) of the vehicle is given by Equation 3, wherein the resistance (Equation 2) is subtracted from the tractoring force (Equation 1). When the tractor is in soft formations it will experience resistance to motion similar to that expressed by Equation 2.

Motion resistance of a track — Equation 2

$$Rc = \frac{1}{(n+1)*b^{(1/n)}*\left(\frac{Kc}{b} + K\phi\right)^{\left(\frac{1}{n}\right)}}*\left(\frac{NF}{l}\right)^{\left(\frac{n+1}{n}\right)}$$

TABLE 2

Motion resistance variables

| Variable name | Symbol | Units |
|---|---|---|
| Cohesive modulus of terrain deformation | Kc | Lb /(in) ^ (2 + n) |
| Frictional modulus of terrain deformation | K ϕ | Lb/(in) ^ (1 + n) |
| Exponent of terrain deformation | n | # |
| Tracks width | b | In |

Off-road vehicle total traction force — Equation 3

$$F = (A*C + NF*\mathrm{Tan}(\phi))*\left[1 - \frac{K}{i*l}*\left(1 - e^{\left(\frac{-i*l}{k}\right)}\right)\right] - \frac{1}{(n+1)*b^{(1/n)}*\left(\frac{Kc}{b} + K\phi\right)^{\left(\frac{1}{n}\right)}}*\left(\frac{NF}{l}\right)^{\left(\frac{n+1}{n}\right)}$$

The general formulation that represents tractoring in hard surfaces is defined by Equation 4. In this equation, the tractoring force (TF) is expressed as a function of the friction coefficient μ, the normal force (NF), a function $f_1$ of the contact area, and another function $f_2$ of the slippage. A simplification utilizes Equation 5; in this equation, the area effect is ignored and the normal force is the one that plays the most important role in the tractoring force. It is valuable to mention that in off-road vehicles theory, the track area is mainly important for soft soils with high levels of sinkage (low values of C) while the normal force is more important in less soft soils with high Phi values. Equation 1 gives insight on these statements.

$$TF = f(\mu, NF, f_1(\text{contact area}), f_2(\text{slippage}))$$

Equation 4—Tractoring force in rigid surface $$TF = \mu*NF*f_2(\text{slippage}))$$

Equation 5—Simplified tractoring force in rigid surface

The actual tractoring power is given by Equation 6. In this equation, (i) is the slippage factor and Vt is the theoretical speed, which is the speed of the track's driving wheel.

$$\text{Actual tractoring power} = (1-i)*Vt*\mu*NF*f_2(i)$$

Equation 6—Tractoring power in rigid surface

Figure 14:
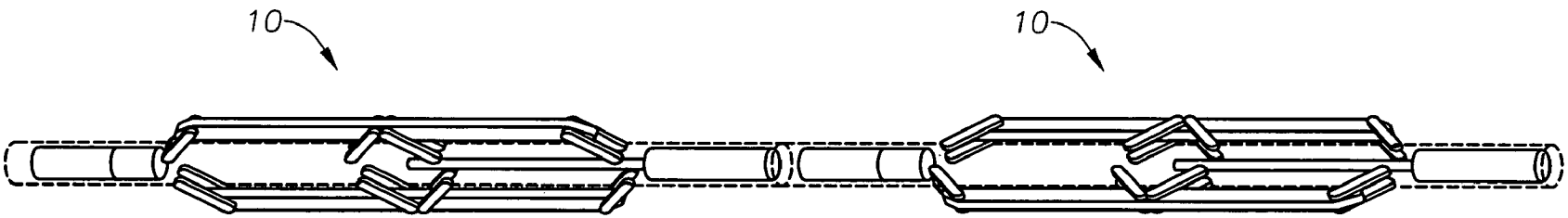
FIG. 14 is a side view of a specific embodiment of the present invention showing the use of two tractors connected in series.

The present invention has a number of advantages, including its modular design, ability to navigate bore holes of varying consistency (e.g., soft, firm, rigid, etc.), and ability to navigate bore holes of irregular cross-sectional profiles, one example of which is a bore hole having an elliptical cross section. In this case, since the present invention is modular, as shown in FIG. 14, it is possible to use two or more consecutive tractors 10 in order to maintain alignment of the axis of the tractor 10 with the axis of the bore. In a specific embodiment, the second tractor 10 may be passive so that, in addition to maintaining alignment, it may also be used to read the slippage that the active tractor 10 is experiencing as it moves within the bore. In a specific embodiment, each of the tractors 10 may include two track assemblies 28, and the two tractors 10 may be connected relative to one another such that the two sets of track assemblies are offset from one another by 90 degrees. An advantage of this configuration is a better centralized tool string. In addition, the tracks will be applied more perpendicularly to the bore hole so as to improve the traction performance. This will also benefit logging tools that measure electrical or acoustic properties of the formation and that need to be centered as precisely as possible to obtain a good measurement of these properties.

Figure 16:
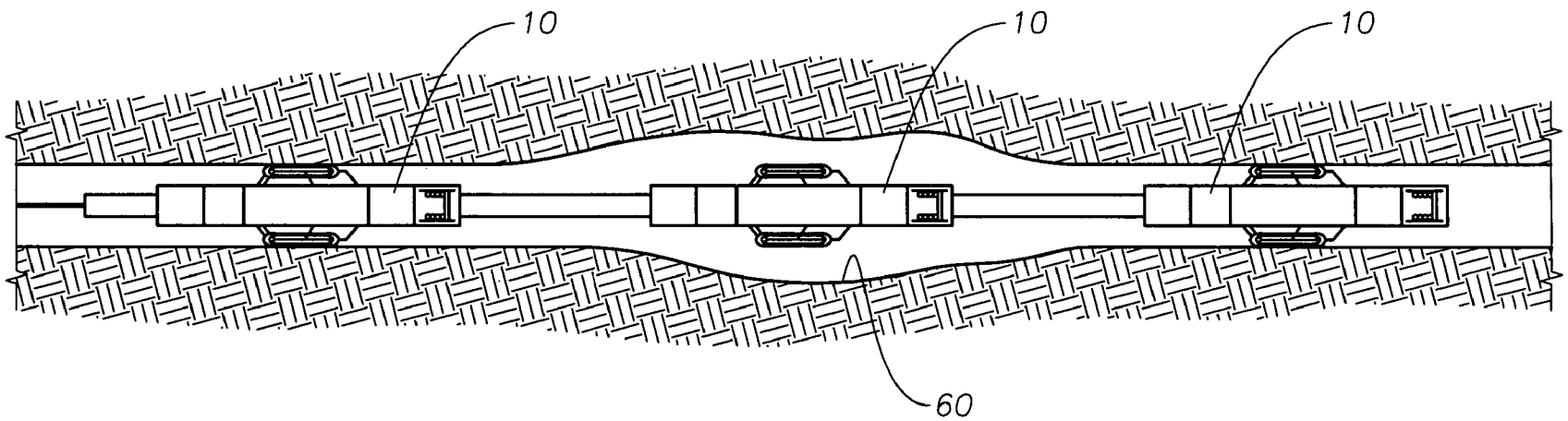
FIG. 16 is a longitudinal cross section of a borehole with a washed-out section with three tractoring modules connected together.

Another example of an irregular borehole profile is commonly referred to as a "wash out", which refers to a portion of the bore hole that has significantly eroded such that the diameter of the bore hole in the area of the erosion is significantly larger than the original diameter of the bore hole. These washed out sections can span a considerable length of the bore; it is not uncommon for them to span twenty or more feet. As shown in FIG. 16, when the tractor 10 enters a washed out area 60 having a diameter larger than its maximum deployed diameter, the tractor 10 will lose contact with the bore hole and free wheel, thereby losing its capacity to perform its function of moving other items within the bore. In these instances, an embodiment of the present invention where two or more tractors 10 are connected to the same string but spaced some distance apart from one another, the distance between at least two tractors 10 being greater than the length of the washed-out section, is particularly applicable. As such, when a tractor 10 enters a washed out area, at least one other tractor 10 will still be in contact with the bore and able to advance the string until the other tractor 10 passes through the washed-out area 60 and regains traction. This embodiment of the present invention is also desirable in navigating restrictions or other obstacles within the bore.

Figure 15:
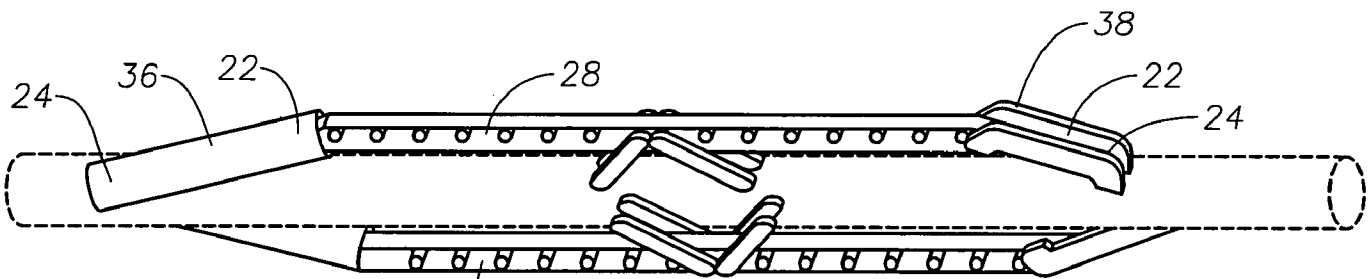
FIG. 15 is a side view of another specific embodiment of the present invention showing the motor and gear box mounted in an arm that may be pivotally connected to the tractor for use in moving the track between open and closed positions.

As previously noted above, the motor 22 and gear box 24 of the present invention may be installed in one or more of the upper and lower arms 36 or 38, a specific embodiment of which is shown in FIG. 15. One advantage of this configuration is that cooling of the motor 22 and gear box 24 is improved as these components will be exposed to cross flow of downhole fluids. This configuration is most advantageously employed in more than two arms when (1) the diameter of the motors and gear boxes are small enough such that they will fit in side-by-side parallel relationship when the track assemblies 28 are in their fully closed positions and enclosed within the tool footprint; or (2) the two or more sets of motors and gear boxes are mounted in lower arms having pivot points that are axially offset from one another.

Figure 17:
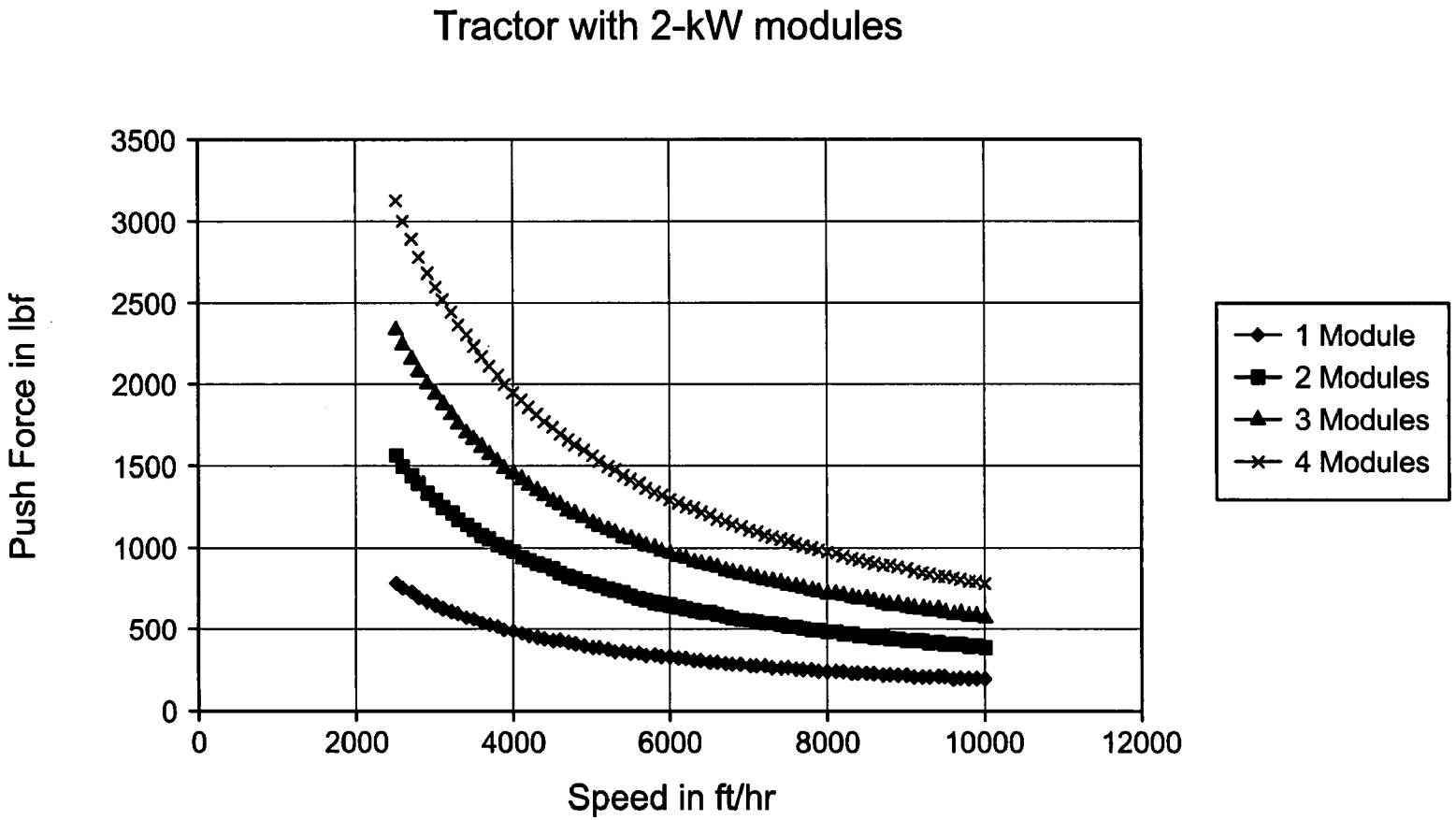
FIG. 17 is a chart illustrating the relationship between force and speed when multiple tractors (modules) of the present invention are connected in series.

Another advantage related to the fact that the present invention is modular relates to load sharing and making the most efficient use of the power that is available in a down hole environment, which is typically understood to be around 9 kW. Due to size, space and heat dissipation considerations, it is not practical, and most likely not possible, to design a tractor with a single motor that would consume all of the 9 kW of available power. In this regard, in a specific embodiment, the tractors 10 are designed to have the force-speed relation illustrated in FIG. 17 which shows the number of 2 kW tractors (modules) 10 that can be selected according to the specific tractoring needs in a given situation.

Figure 18:
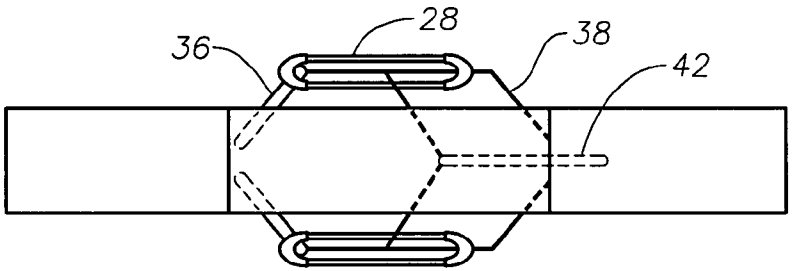
FIG. 18 is a side view of a specific embodiment of the present invention showing one example of the track assembly.
Figure 19:
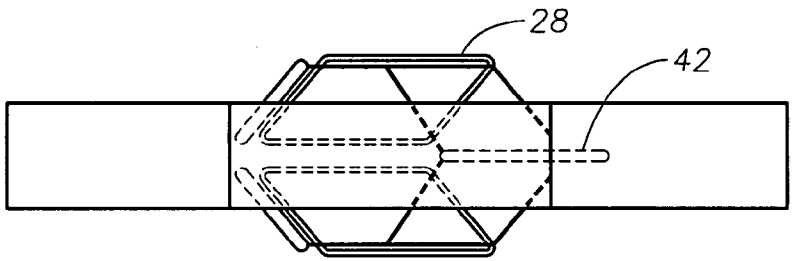
FIG. 19 is a side view of a specific embodiment of the present invention which is similar to FIG. 18, but shows a track assembly in the shape of a parallelogram.
Figure 20:
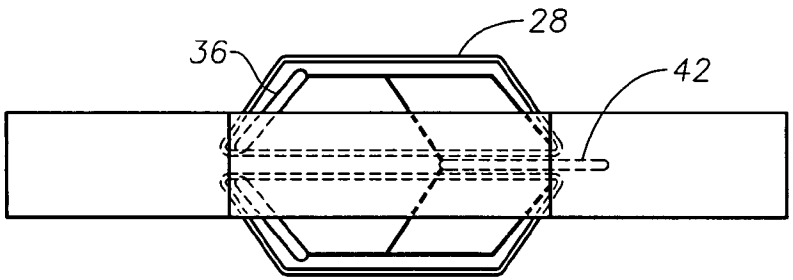
FIG. 20 is a side view of a specific embodiment of the present invention which is similar to FIGS. 18–19, but shows a track assembly in the shape of a trapezoid.
Figure 21:
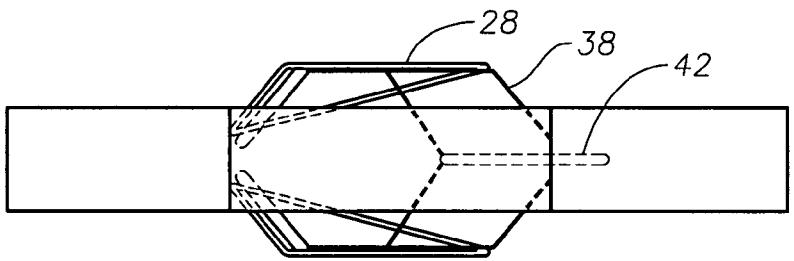
FIG. 21 is a side view of a specific embodiment of the present invention which is similar to FIGS. 18–20, but shows a track assembly in the shape of a triangle.

The present invention is also not limited to any particular configuration for the track assembly 28. In a specific embodiment, the track assembly 28 may be configured so that the track loops around two spaced wheels with one or more wheels disposed therebetween, such as shown in FIG. 3, discussed above, or such as depicted in FIG. 18. In another specific embodiment, as shown in FIG. 19 (and as also shown in the above-mentioned pending application U.S. Ser. No. 10/857,395 entitled "Chain Drive System"), the track assembly 28 may be configured such that the track path follows the general shape of a parallelogram. In another specific embodiment, as shown in FIG. 20, the track assembly 28 may be configured such that the track path follows the general shape of a trapezoid. In another specific embodiment, as shown in FIG. 21, the track assembly 28 may be configured such that the track path follows the general shape of a triangle. FIG. 22 illustrates another specific embodiment of a track assembly in a generally parallelogram configuration (similar to that shown in FIG. 19). FIGS. 23–31 illustrate yet another specific embodiment in a parallelogram configuration, and more particularly shows track on the track assembly 28 in of a chain-link and roller configuration (see rollers 62 on chain-link track 64 in FIGS. 27–31) and the slider assembly 52 connected between the track assembly 28 and lower arm 38. The embodiment of FIGS. 23–31 may include a chain track 64 or manner for driving the chain track such as disclosed in the above-mentioned patent application U.S. Ser. No. 10/857,395 entitled "Chain Drive System".

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

The invention claimed is:

1. A downhole tractor comprising:

a track assembly including a rotatable track;

a motor adapted to rotate the track;

a lower arm having a first end supported by a tractor housing, and a second end connected to the track assembly;

an upper arm having a first end supported by the tractor housing, and a second end connected to the track assembly; and an actuator arm mounted to move the track assembly between open and closed positions.

2. The downhole tractor of claim 1, wherein the track is rotatably disposed about a plurality of wheels mounted to the track assembly.

3. The downhole tractor of claim 1, wherein the track includes a plurality of wheels.

4. The downhole tractor of claim 1, further including one of a rotatable screw and a rod, and wherein the actuator arm includes a first end pivotally connected to one of the screw and the rod and a second end pivotally connected to the track assembly.

5. The downhole tractor of claim 1, wherein the track rotates along a path defined by the general shape of one of an oval, parallelogram, trapezoid and triangle.

6. The downhole tractor of claim 1, further including a transmission connected between the motor and a driven wheel adapted to rotate the track.

7. The downhole tractor of claim 1, further including a rotatable screw connected, directly or indirectly, to the actuator arm, whereby the screw causes the actuator arm to move the track assembly towards its open position when the screw is rotated in a first direction and to move the track assembly towards its closed position when the screw is rotated in second direction.

8. The downhole tractor of claim 1, further including a rod connected to the actuator arm, whereby the rod causes the actuator arm to move the track assembly towards its open position when the rod is moved in a first direction and to move the track assembly towards its closed position when the rod is moved in second direction.

9. The downhole tractor of claim 1, wherein the first end of the lower arm is disposed for movement within a slot in the tractor housing.

10. The downhole tractor of claim 1, further including a slider assembly connected to the track assembly and the lower arm, and adapted to permit relative movement between the track assembly and the lower arm.

11. The downhole tractor of claim 1, further including a slider assembly having an inner member disposed for movement within a bore of an outer member, one of the inner member and outer member being connected to the upper arm and the other of the inner member and the outer member being connected to the track assembly.

12. The downhole tractor of claim 1, wherein the actuator arm includes a wheel engaged with a ramp mounted to the tractor housing.

13. The downhole tractor of claim 1, wherein the track assembly further includes a driven wheel coupled directly or indirectly to the motor.

14. The downhole tractor of claim 1, wherein the motor is coupled directly or indirectly to a rotatable screw that is engaged with the track, whereby rotation of the screw causes rotation of the track.

15. A downhole tractor comprising:

a track assembly including a plurality of idler wheels and a continuous track rotatably disposed around the idler wheels;

a motor adapted to rotate the track around the idler wheels;

a lower arm having a first end pivotally connected to a tractor housing, and a second end pivotally connected to the track assembly;

an upper arm having a first end pivotally connected to the tractor housing, and a second end pivotally connected to the track assembly;

one of a rotatable screw and a rod; and a link assembly including a first link having a first end pivotally connected to one of the screw and the rod and a second end pivotally connected to the track assembly, and a second link having a first end pivotally connected to the track assembly and a second end pivotally mounted to the tractor housing.

16. The downhole tractor of claim 15, wherein the second end of the first link and the first end of the second link are pivotally mounted to the track assembly at a pivot point on the track assembly.

17. The downhole tractor of claim 15, wherein the first end of the lower arm is disposed for movement within a slot in the tractor housing.

18. The downhole tractor of claim 15, wherein the track rotates along a path defined by the general shape of one of an oval, parallelogram, trapezoid and triangle.

19. The downhole tractor of claim 15, further including a transmission connected between the motor and a driven wheel.

20. The downhole tractor of claim 15, further including a hydraulic system adapted to move the rod between a first position in which the track assembly is in a closed position and a second position in which the track assembly is in an open position.

21. The downhole tractor of claim 15, further including a second motor adapted to rotate the screw in a first direction to cause the track assembly to move towards an open position and a second direction to cause the track assembly to move towards a closed position.

22. The downhole tractor of claim 15, wherein one of the screw and rod is adapted to move the first end of the first link in a direction generally parallel to a central axis of the tractor housing.

23. The downhole tractor of claim 15, further including a slider assembly connected to the track assembly and the lower arm, and adapted to permit relative movement between the track assembly and the lower arm.

24. The downhole tractor of claim 15, wherein the track assembly further includes a driven wheel coupled directly or indirectly to the motor.

25. The downhole tractor of claim 15, wherein the motor is coupled directly or indirectly to a second rotatable screw that is engaged with the track, whereby rotation of the second rotatable screw causes rotation of the track.

26. A downhole tractor comprising:

a track assembly including a plurality of idler wheels and a continuous track rotatably disposed around the idler wheels;

a motor adapted to rotate the track around the idler wheels;

a lower arm having a first end pivotally connected to a tractor housing, and a second end pivotally connected to the track assembly;

an upper arm having a first end pivotally connected to the tractor housing, and a second end pivotally connected to the track assembly;

one of a rotatable screw and a rod; and an actuator arm having a first end pivotally connected to one of the screw and the rod, a second end pivotally connected to the track assembly, and a wheel engaged with a ramp connected to the tractor housing.

27. The downhole tractor of claim 26, wherein the first end of the lower arm is disposed for movement within a slot in the tractor housing.

28. The downhole tractor of claim 26, further including a transmission connected between the motor and a driven wheel.

29. The downhole tractor of claim 26, further including a hydraulic system adapted to move the rod between a first position in which the track assembly is in a closed position and a second position in which the track assembly is in an open position.

30. The downhole tractor of claim 26, further including a second motor adapted to rotate the screw in a first direction to cause the track assembly to move towards an open position and a second direction to cause the track assembly to move towards a closed position.

31. The downhole tractor of claim 26, wherein one of the screw and rod is adapted to move the first end of the first link in a direction generally parallel to a central axis of the tractor housing.

32. The downhole tractor of claim 26, further including a slider assembly connected to the track assembly and the lower arm, and adapted to permit relative movement between the track assembly and the lower arm.

33. The downhole tractor of claim 26, wherein the track assembly further includes a driven wheel coupled directly or indirectly to the motor.

34. The downhole tractor of claim 26, wherein the motor is coupled directly or indirectly to a second rotatable screw that is engaged with the track, whereby rotation of the second rotatable screw causes rotation of the track.

35. The downhole tractor of claim 26, wherein the motor is disposed on one of the upper or the lower arms.

36. A method of conveying an item in a well bore, comprising:

providing a downhole tractor including a track assembly including a rotatable track, a motor adapted to rotate the track, a lower arm having a first end pivotally connected to a tractor housing and a second end pivotally connected to the track assembly, an upper arm having a first end pivotally connected to the tractor housing and a second end pivotally connected to the track assembly, and an actuator arm mounted to move the track assembly between open and closed positions;

connecting the item to the tractor, engaging the track with an inner surface of the well bore, activating the motor, and moving the tractor along the surface.

37. The method of claim 36, further including providing a second downhole tractor.

38. The method of claim 36, further including providing a second downhole tractor spaced from the downhole tractor by a distance greater than a length of a washed out section of a well bore.

39. The method of claim 37, further wherein the second downhole tractor comprises a track assembly, the second tractor being orientated such that the track assembly of the second tractor is offset from the track assembly of the first tractor.

40. The method of claim 39, further wherein the track assembly of the second tractor is offset 90 degrees from the track assembly of the first tractor.

41. The method of claim 37, further wherein the second tractor reads the slippage of the first tractor.

42. A downhole tractor comprising:

a track assembly including a plurality of idler wheels and a continuous track rotatably disposed around the idler wheels;

a first motor adapted to rotate the track around the idler wheels;

a lower arm having a first end pivotally connected to a tractor housing, and a second end pivotally connected to the track assembly;

an upper arm having a first end pivotally connected to the tractor housing, and a second end pivotally connected to the track assembly;

one of a rotatable screw and a rod; and a link assembly including a first link having a first end pivotally connected to one of the screw and the rod and a second end pivotally connected to the track assembly, and a second link having a first end pivotally connected to the track assembly and a second end pivotally mounted to the tractor housing, wherein the motor is disposed on one of the upper and lower arms.

43. The downhole tractor of claim 42, further including a second motor adapted to rotate the one of screw and rod in a first direction to cause the track assembly to move towards an open position and a second direction to cause the track assembly to move towards a closed position.

44. The downhole tractor of claim 42 wherein the second motor is disposed on one of the upper and lower arms.

45. The downhole tractor of claim 44 wherein the first and second motors are disposed on different ones of the upper and lower arms.

* * * * *